US011198656B2

(12) United States Patent
Pourpoint et al.

(10) Patent No.: US 11,198,656 B2
(45) Date of Patent: Dec. 14, 2021

(54) HYPERGOLIC HYDROCARBON FUEL

(71) Applicant: Purdue Research Foundation, West Lafayette, IN (US)

(72) Inventors: Timothee L Pourpoint, West Lafayette, IN (US); Trenton H Parsell, Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 505 days.

(21) Appl. No.: 15/920,521

(22) Filed: Mar. 14, 2018

(65) Prior Publication Data

US 2018/0265427 A1 Sep. 20, 2018

Related U.S. Application Data

(60) Provisional application No. 62/472,649, filed on Mar. 17, 2017.

(51) Int. Cl.

| | |
|---|---|
| ***C06B 43/00*** | (2006.01) |
| ***C06D 5/08*** | (2006.01) |
| ***C06B 47/04*** | (2006.01) |

(52) U.S. Cl.

CPC ..... *C06B 43/00* (2013.01); *C06B 47/04* (2013.01); *C06D 5/08* (2013.01)

(58) Field of Classification Search

None

See application file for complete search history.

(56) References Cited

U.S. PATENT DOCUMENTS

| | | | | |
|---|---|---|---|---|
| 3,883,376 | A * | 5/1975 | Billig | C10L 1/30 149/22 |
| 5,906,662 | A * | 5/1999 | McCombes | C10L 1/003 44/300 |
| 6,835,218 | B1 * | 12/2004 | Drozd | F02M 37/32 44/459 |
| 8,894,782 | B2 | 11/2014 | Dobbins et al. | |
| 2011/0107659 | A1 | 5/2011 | Gruter et al. | |
| 2015/0225324 | A1 * | 8/2015 | Cheng | C07C 29/88 44/411 |

OTHER PUBLICATIONS

Benhidjeb-Carayon, A., Gabl, J., and Pourpoint, T., "Hypergolicity of Mixed Oxides of Nitrogen with Solid Fuels for Hybrid Rocket Application," 53rd AIAA/SAE/ASEE Joint Propulsion Conference, Atlanta, GA, Jul. 10-12, 2017; Copyright © 2017 American Institute of Aeronautics and Astronautics (AIAA).

* cited by examiner

*Primary Examiner* — Aileen B Felton
(74) *Attorney, Agent, or Firm* — Purdue Research Foundation

(57) ABSTRACT

The present application generally relates to hypergolic hydrocarbon fuel compositions comprising a convenient fuel and a cycloheptatriene and/or its analogs, and methods of making and using the hypergolic hydrocarbon fuel compositions.

4 Claims, No Drawings

HYPERGOLIC HYDROCARBON FUEL

CROSS-REFERENCE TO RELATED APPLICATION

The present U.S. patent application is related to and claims the priority of U.S. Provisional Application Ser. No. 62/472,649, filed Mar. 17, 2017, the contents of which are hereby incorporated by reference in its entirety into this application.

TECHNICAL FIELD

The present disclosure generally relates to hypergolic hydrocarbon fuel compositions comprising a cycloheptatriene and/or its analogs, and methods of making and using the hypergolic hydrocarbon fuel compositions.

BACKGROUND

This section introduces aspects that may help facilitate a better understanding of the disclosure. Accordingly, these statements are to be read in this light and are not to be understood as admissions about what is or is not prior art.

The present disclosure relates reduced toxicity fuels, and more particularly, to reduced toxicity fuels containing hydrocarbons having three conjugated double bonds within a 7-membered carbon ring. The disclosed fuels are hypergolic with nitrogen tetroxide, red fuming nitric acid, nitric oxide or any combination as well.

Hypergolic propellants are combinations of fuels and oxidizers that ignite spontaneously upon contact with one another and require no ignition source. The extremely rapid, reliable start and re-start capability of hypergolic propellants make them ideal for spacecraft maneuvering systems. In addition, since hypergolic propellants remain liquid at ordinary temperatures, they do not pose the storage problems of cryogenic propellants.

The hypergolic fuels currently in widespread use are highly toxic and must be handled with extreme care. Examples of these fuels include hydrazine, monomethylhydrazine (MMH) and unsymmetrical dimethylhydrazine (UDMH). The oxidizers typically used with these fuels to provide a hypergolic bipropellant system include nitrogen tetroxide ($N_2O_4$) and nitric acid ($HNO_3$).

Both unsymmetrical dimethylhydrazine and monomethylhydrazine are confirmed animal carcinogens that have been characterized as tumorigenic, mutagenic, reproductive effectors.

This extreme toxicity and the associated difficulties and expense of transporting and handling these compounds have produced widespread interest in finding replacement fuels.

There is, therefore an unmet need for safer and more convenient hypergolic fuel compositions and methods to make and use of the hypergolic fuel compositions.

SUMMARY

One of the primary objectives of the present disclosure is to provide hypergolic fuel compositions with reduced toxicity while maintain the desired ignition delay time and the convenience of uses the compositions.

In one embodiment, the present disclosure provides hypergolic fuel compositions comprising a conventional fuel and a compound of formula (I):

(I)

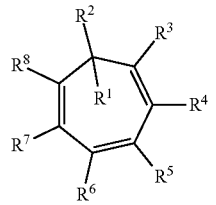

wherein $R^1$-$R^8$ are each independently H, —$NR^9R^{10}$, —$OR^{11}$, —NH(C═O)—$R^{12}$, —O(C═O)—$R^{13}$, —CN, —$NO_2$, —$CF_3$, —(C═O)$R^{14}$, —$COOR^{15}$, halogen, C1-C8 straight or branched alkyl, C1-C8 straight or branched alkenyl, C1-C8 straight or branched alkynyl, or C3-C8 cycloalkyl, and wherein $R^1$ and $R^2$ can form an exocyclic double bond ═X, wherein ═X is ═$CR^{16}R^{17}$, ═$NR^{18}$, or ═O; and $R^9$-$R^{18}$ are each independently H, C1-C8 straight or branched alkyl.

In another embodiment, the present disclosure provides a method for producing a hypergolic propellant comprising contacting a hypergolic fuel composition with an oxidizer wherein said hypergolic fuel composition comprises a compound represented by the formula (I).

DETAILED DESCRIPTION

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

In the present disclosure the term "about" can allow for a degree of variability in a value or range, for example, within 10%, within 5%, or within 1% of a stated value or of a stated limit of a range.

In the present disclosure the term "substantially" can allow for a degree of variability in a value or range, for example, within 90%, within 95%, or within 99% of a stated value or of a stated limit of a range.

A hypergolic propellant used in a rocket engine usually comprises two components that can spontaneously ignite when they come into contact with each other.

The two propellant components usually comprises a fuel and an oxidizer. Although commonly used hypergolic propellants are difficult to handle because of their extreme toxicity and/or corrosiveness, they can be stored as liquids at room temperature and hypergolic engines are easy to ignite reliably and repeatedly.

In contemporary usage, the terms "hypergol" and/or "hypergolic propellant" usually mean the most common such propellant combinations, such as dinitrogen tetroxide plus hydrazine and/or its relatives monomethylhydrazine and unsymmetrical dimethylhydrazine.

Both unsymmetrical dimethylhydrazine and monomethylhydrazine are confirmed animal carcinogens that have been characterized as tumorigenic, mutagenic, reproductive effectors.

This extreme toxicity and the associated difficulties and expense of transporting and handling these compounds have produced widespread interest in finding replacement fuels.

There is, therefore an unmet need for safer and more convenient hypergolic fuel compositions and methods to make and use of the hypergolic fuel compositions.

To become an acceptable hypergolic fuel, a hypergolic fuel should not only provide robust burning capability, but also should have a desire ignition delay time. In addition, a good hypergolic fuel should be miscible with some other conventional fuel such as kerosene.

The present disclosure therefore provides a hypergolic fuel composition that exhibit these advantages.

In one embodiment, the present invention provides a hypergolic fuel composition comprising a conventional fuel and a compound of formula (I):

(I)

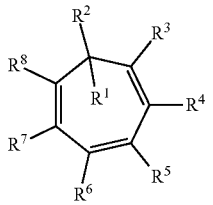

wherein $R^1$-$R^8$ are each independently H, —$NR^9R^{10}$, —$OR^{11}$, —NH(C═O)—$R^{12}$, —O(C═O)—$R^{13}$, —CN, —$NO_2$, —$CF_3$, —(C═O)$R^{14}$, —$COOR^{15}$, halogen, C1-C8 straight or branched alkyl, C1-C8 straight or branched alkenyl, C1-C8 straight or branched alkynyl, or C3-C8 cycloalkyl, and wherein $R^1$ and $R^2$ can form an exocyclic double bond ═X, wherein ═X is ═$CR^{16}R^{17}$, ═$NR^{18}$, or ═O; and $R^9$-$R^{18}$ are each independently H, C1-C8 straight or branched alkyl.

In one embodiment, the present invention provides a hypergolic fuel composition comprising a conventional fuel and a compound of formula (I), wherein $R^1$-$R^8$ are each independently H, —$NR^9R^{10}$, —$OR^{11}$, —NH(C═O)—$R^{12}$, —O(C═O)—$R^{13}$, —CN, —$NO_2$, —$CF_3$, —(C═O)$R^{14}$, —$COOR^{15}$, halogen, C1-C4 straight or branched alkyl, C1-C4 straight or branched alkenyl, C1-C4 straight or branched alkynyl, or C3-C7 cycloalkyl, and wherein $R^1$ and $R^2$ can form an exocyclic double bond ═X, wherein ═X is ═$CR^{16}R^{17}$, ═$NR^{18}$, or ═O; and $R^9$-$R^{18}$ are each independently H, C1-C4 straight or branched alkyl.

In one embodiment, the present invention provides a hypergolic fuel composition comprising a conventional fuel and a compound of formula (I), wherein $R^1$-$R^8$ are each independently H, —$NR^9R^{10}$, —$OR^{11}$, —CN, —$NO_2$, —$CF_3$, —$COOR^{15}$, halogen, C1-C4 straight or branched alkyl, C1-C4 straight or branched alkenyl, C1-C4 straight or branched alkynyl, or C3-C7 cycloalkyl, and wherein $R^1$ and $R^2$ can form an exocyclic double bond ═X, wherein ═X is ═$CR^{16}R^{17}$, ═$NR^{18}$, or ═O; and $R^9$-$R^{18}$ are each independently H, C1-C4 straight or branched alkyl In one embodiment, the present invention provides a hypergolic fuel composition comprising a salt formed by the deprotonation of a compound of formula (I), wherein at least one of $R^1$ and $R^2$ is hydrogen in the compound of formula (I) before the compound of formula (I) is deprotonated. The counter ion can be any suitable counter ion including but is not limited to F—, $Cl^-$, $Br^-$, $I^-$, $OH^-$, $CN^-$, $NO_3^-$, $HCO_3^-$.

In one embodiment, the present invention provides a hypergolic fuel composition comprising a conventional fuel and a compound of formula (I), wherein $R^1$-$R^8$ are H.

In one embodiment, the present invention provides a hypergolic fuel composition comprising a conventional fuel and a compound of formula (I), wherein the conventional fuel is a traditional energy sources or fossil fuels such as petroleum, oil, coal, propane, kerosene, and natural gas. In one embodiment, the conventional fuel is kerosene.

The oxidizers typically used with fuels to provide a hypergolic bipropellant system include but is not limited to nitrogen tetroxide ($N_2O_4$), nitric oxide (NO), nitric acid ($HNO_3$), or any combination thereof.

In one embodiment, the present disclosure provides that the mass ratios of oxidizer-to-fuel will typically range from 1:10 to 10:1.

In one embodiment, the present disclosure provides that the weight percentage of the compound of formula (I) in the hypergolic fuel composition is about 5.0-99.9 wt %. In one embodiment, the weight percentage of the compound of formula (I) in the hypergolic fuel composition is about 10.0-99.9 wt %. In one embodiment, the weight percentage of the compound of formula (I) in the hypergolic fuel composition is about 20.0-99.9 wt %. In one embodiment, the weight percentage of the compound of formula (I) in the hypergolic fuel composition is about 30.0-99.9 wt %. In one embodiment, the weight percentage of the compound of formula (I) in the hypergolic fuel composition is about 40.0-99.9 wt %. In one embodiment, the weight percentage of the compound of formula (I) in the hypergolic fuel composition is about 50.0-99.9 wt %. In one embodiment, the weight percentage of the compound of formula (I) in the hypergolic fuel composition is about 60.0-99.9 wt %. In one embodiment, the weight percentage of the compound of formula (I) in the hypergolic fuel composition is about 70.0-99.9 wt %. In one embodiment, the weight percentage of the compound of formula (I) in the hypergolic fuel composition is about 90.0-99.9 wt %. In one embodiment, the weight percentage of the compound of formula (I) in the hypergolic fuel composition is about 90.0-99.9 wt %.

In one embodiment, the present disclosure provides that the compound of formula (I) is miscible with the conventional fuel. In one aspect, the compound of formula (I) is miscible with kerosene.

In one embodiment, the present disclosure provides that the compound of formula (I) may provide an ignition delay of 1 ms-200 ms. In one aspect, the compound of formula (I) may provide an ignition delay of 1 ms-100 ms. In one aspect, the compound of formula (I) may provide an ignition delay of 1 ms-50 ms. In one aspect, the compound of formula (I) may provide an ignition delay of 5 ms-25 ms.

In one In one embodiment, the present disclosure provides a method for producing a hypergolic propellant comprising contacting a hypergolic fuel with an oxidizer wherein said hypergolic fuel comprises a compound represented by the formula (I). In one aspect, the oxidizer may be selected but is not limited to nitrogen tetroxide ($N_2O_4$), nitric acid ($HNO_3$), or a mixture such as "MON-25", which is $N_2O_4$ with 25% nitric oxide (NO), or any combination thereof.

Example

The compound of formula (I) is either used as pure form or mixed with one or more appropriate conventional fuel such as kerosene. Cycloheptatriene (CHT) is an exemplary fuel of the present disclosure. The weight percentage of CHT in the CHT/conventional fuel mixture may be in the range of 5-100%.

Liquid nitrogen tetroxide (NTO) is condensed in a water chilled condenser. The stopper is raised to allow a single drop of NTO to fall onto the fuel. About 3 drops of a fuel sample are contained in a vial 5 inches below the bottom of the condenser. The vial is set centered on a micrometer x-y stage. The event is illuminated by LEDs and filmed by a Vision Research Phantom V1212 high speed color camera. Analysis of the high speed video determines the ignition delay, defined as the time from first liquid contact to the first emission of visible light. The camera films at 10,000 frames per second, providing±0.1 ms uncertainty on contact and the same on flame emission. The total uncertainty of the ignition delay measurement is thus±0.2 ms.

TABLE 1

Hypergolic reaction of cycloheptatriene (CHT) with liquid nitrogen tetroxide (NTO) (Reaction was carried out under ambient pressure and at 15° C. All fuels were purchased from chemical suppliers (i.e. Sigma-Aldrich, etc.) and used as is).

| Chemical Name | Notes on Reaction | Ignition Delay (ms) |
|---|---|---|
| Cycloheptatriene (CHT) (100%) | Bright carbon flame, low "whoosh" as opposed to strong "pop", ignition on 3/3 tests | 18.7 (n1 = 14.8, n2 = 23.8, n3 = 17.5) |

TABLE 2

Hypergolic Reaction between cycloheptatriene (CHT) composition (with or without kerosene) and liquid nitrogen tetroxide (NTO) or MON-25 (N2O4 with 25% nitric oxide). The reaction was carried out at 80 psi (5.5 atm)

| Wt. % CHT | Freezing Point (° C.) | Boiling Point (° C.) | Ignition Delay, MON-25 (ms) | Ignition Delay, NTO (ms) |
|---|---|---|---|---|
| 100 | −67 | 115 | 6.1 | 23.8 |
| 80 | −89 | 127 | 14.5 | no reaction |
| 20 | −81 | 193 | 29.7 | no reaction |

The results demonstrate that CHT or CHT/kerosene mixture can react with NTO and/or MON-25 at appropriate conditions to provide ignition delay that may be sufficient as desired hypergolic fuel compositions.

In addition, CHT demonstrated excellent miscibility with kerosene. The mixture of CHT and kerosene has lower freezing point and higher boiling point comparing to pure form of CHT. The lower freezing point and higher boiling point are desired for hypergolic fuels because the broader temperature range may provide more convenient applications at a wide variety of conditions.

Those skilled in the art will recognize that numerous modifications can be made to the specific implementations described above. The implementations should not be limited to the particular limitations described. Other implementations may be possible.

The invention claimed is:

1. A hypergolic fuel composition system comprising a first standalone oxidizer composition having an oxidizer selected from the group consisting of $N_2O_4$, NO, $HNO_3$, and a combination thereof; and a second standalone fuel composition having an optional conventional fuel, and a compound of formula (I):

(I)

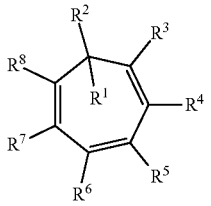

wherein $R^1$-$R^8$ are each independently H, —$NR^9R^{10}$, —$OR^{11}$, —NH(C═O)—$R^{12}$, —O(C═O)—$R^{13}$, —CN, —$NO_2$, —$CF_3$, —(C═O)$R^{14}$, —$COOR^{15}$, halogen, C1-C8 straight or branched alkyl, C1-C8 straight or branched alkenyl, C1-C8 straight or branched alkynyl, or C3-C8 cycloalkyl, and wherein $R^1$ and $R^2$ can form an exocyclic double bond═X, wherein═X is ═$CR^{16}R^{17}$, ═$NR^{18}$, or ═O; and $R^9$-$R^{18}$ are each independently H, C1-C8 straight or branched alkyl, wherein the hypergolic fuel composition system provides an ignition delay of 1 ms-100 ms when the second standalone fuel composition is treated with the first standalone oxidizer composition to generate a spontaneously ignition.

2. The fuel composition system of claim 1, wherein the compound of formula (I) is cycloheptatriene.

3. The fuel composition system of claim 1, wherein the conventional fuel comprises kerosene.

4. The fuel composition system of claim 1, wherein the weight percentage of the compound of formula (I) is 20-100% in the second standalone fuel composition.

* * * * *